US007921930B2

(12) United States Patent
Sanelli

(10) Patent No.: US 7,921,930 B2
(45) Date of Patent: Apr. 12, 2011

(54) METHOD AND APPARATUS FOR INSTALLING A SHANK WITHIN A RIPPER ASSEMBLY OF A TRACTOR/CRAWLER INVOLVING A ROTATING SHANK INSTALLER

(75) Inventor: Antonio Sanelli, Concord, CA (US)

(73) Assignee: Sanelli Family Trust, Concord, CA (US)

( * ) Notice: Subject to any disclaimer, the term of this patent is extended or adjusted under 35 U.S.C. 154(b) by 52 days.

(21) Appl. No.: 12/502,105

(22) Filed: Jul. 13, 2009

(65) Prior Publication Data

US 2011/0005782 A1 Jan. 13, 2011

(51) Int. Cl.
*A01B 79/00* (2006.01)

(52) U.S. Cl. ..... 172/1; 172/699; 172/684

(58) Field of Classification Search ..... 172/1, 699, 172/700, 684, 762
See application file for complete search history.

(56) References Cited

U.S. PATENT DOCUMENTS 2,552,292 A * 5/1951 Metz et al. ..... 172/683
3,901,328 A * 8/1975 Stanfield ..... 172/699
4,040,261 A * 8/1977 Schuck et al. ..... 405/182
4,103,443 A * 8/1978 Pelsy ..... 37/370
4,119,157 A * 10/1978 Schuck et al. ..... 172/477
4,313,504 A * 2/1982 Fischer ..... 172/382
4,618,005 A * 10/1986 Tower ..... 172/459

* cited by examiner

*Primary Examiner* — Robert E Pezzuto
*Assistant Examiner* — Jamie L McGowan

(57) ABSTRACT

An apparatus and method of installing a shank onto a ripper assembly of a tractor or crawler. A rotating shank installer (RSI) is welded onto a front face of a ripper assembly of a tractor, e.g., on the outside surface of a pocket beam. A portion of the RSI is allowed to rotate with respect to the pocket beam. With the shank in a substantially horizontal position with respect to the ground, the shank is secured between two plates of the RSI using pins wherein the plates can rotate with respect to the pocket beam. The shank is locked in place by two pins placed through the plates and the shank's weight is unbalanced with respect to the RSI. The ripper assembly is elevated causing the shank to rotate within the RSI to a substantially vertical position. The crawler is moved forward while lowering the ripper assembly in order to rip a groove into the ground with the bottom portion of the shank where the shank lowers into the ground. The RSI is disconnected from the shank wherein the shank is held in place by the grove. The bottom of the pocket is positioned over the top of the lowered shank and the pocket is lowered so that the shank is installed within the pocket and secured therein.

4 Claims, 22 Drawing Sheets

400

METHOD AND APPARATUS FOR INSTALLING A SHANK WITHIN A RIPPER ASSEMBLY OF A TRACTOR/CRAWLER INVOLVING A ROTATING SHANK INSTALLER

TECHNICAL FIELD

The embodiments of the present invention relate to heavy equipment operation and specifically to outfitting a tractor/crawler with a shank for ripping.

BACKGROUND ART

FIG. 1A illustrates a prior art crawler 190 having a ripper assembly 195 in the rear. The ripper assembly includes hydraulic cylinders 197 and 198 that control the height and pitch of the ripper assembly. The ripper assembly 195 is also shown with a small length shank 120 installed therein. Shanks of small lengths, as shown in FIG. 1A are typically used for construction jobs.

FIG. 1B illustrates the ripper assembly 195 in more detail with shank 120 installed therein. Also shown in FIG. 1B is an extended length shank 125. In general, a crawler 190 uses the extended shank 125 for farming purposes for planting or re-planting an orchard, e.g., to rip a groove several feet deep in a process called deep ripping, also called subsoiling. A pocket 130 within the ripper assembly 195 of the crawler (a large tractor with tracks) is used to hold the shank 125 vertically with a portion of the shank disposed under ground. The pocket 130 is a slot made through the pocket beam 135. The crawler moves forward slowly while holding the shank 125 and thereby rips a groove in the dirt.

However, crawlers are not equipped with a mechanism to install the shank 125 into the pocket 130. The problem with installing the extended length shank 125 is that the height of the shank 125 when positioned vertically, as shown in FIG. 1B, is much higher than the height that the ripper assembly 195 can raise the pocket 130. Installing an extended length shank 125 into the crawler's pocket 130 is a lengthy, manual, and very dangerous process involving several workers. Depending on the conditions in the field, the shank installation time may vary considerably making the process of shank installation very unpredictable. Also, the shank 125 may weigh thousands of pounds (e.g., 3,500 pounds) and installing the shank 125 into the crawler's pocket portion 130 may result in serious bodily injury if not done properly.

As stated above, the height of the shank 125 when positioned vertically, as shown in FIG. 1B, is much higher than the height that the ripper assembly 195 can raise the pocket 130. Therefore, when the ripper assembly 195 is fully raised, the shank 125 is taller than the height of the bottom of the pocket 130. Therefore, it is not possible to install the shank within the pocket, unless the shank is somehow depressed into the ground or an uneven surface is located, e.g., a stair-stepped surface is present in the field. The problem of shank installation is exacerbated if the crawler needs to be transported often because the crawler cannot be transported with the extended length shank installed due to state law weight restrictions on transport low beds. In other words, when ripping services are contracted to farmers, etc., the crawler and shank need to be transported from job site to job site. Because the crawler cannot be transported with the shank installed, each time the crawler needs to be re-located, the extended length shank needs to be removed, transported on a separate smaller trailer and re-installed. This is typically not a problem with respect to the shorter shank of FIG. 1A because the shorter shank 120 can be left installed during transportation. Furthermore, construction jobs typically do not involve so much travel because the job lengths are longer when compared to ripping.

Today, there are several ways in which the extended length shank 125 can be depressed into the ground to lower its height for installation, but these methods are manual, time consuming, dangerous and often rely too heavily on conditions in the field which are unpredictable. In one method, the shank is removed from a trailer using the ripper assembly of the crawler. The shank is tied to the ripper assembly with two chains with the pointed end of the shank positioned lower and downward. The shank is then dropped so that its weight drives the pointed end in to the ground and the shank is left at an angle to the ground (not perpendicular) hoping that when the chains are removed it will stay in this position. The crawler then uses one of its tracks to climb up the length shank, thereby pushing it deeper into the ground. When it has been pushed enough, the crawler repositions itself in front of the top part of the shank and backs into it. Using the ripper beam touching the top of the shank which is at an approximate 45 degrees, the crawler applies pressure hydraulically as it moves backwards, causing the shank to go further down and more vertical, though not at the perfect angle. If process was successful at driving the shank deep enough, then the tractor will back into the shank to straighten it up. At this point the ripper assembly can be properly positioned over the top of the shank and inserted. This process is very labor intensive, dangerous, unpredictable and is rarely successful, depending on the conditions of the ground, etc. Moreover, if the shank is unable to be depressed into the ground a sufficient amount, then objects can be placed under the crawler's tracks to raise the ripper assembly by backing onto to them so that the pocket can be positioned over the shank's top to hammer and/or align the shank for proper installation. However, because of the weight of the tractor (approximately 115 tons), any objects used to elevate the machine are lost into the ground. This is usually only tried if it is believed that the ground is hard enough to withstand its weight.

Another method for installing the shank involves using a chain with a loop secured through the lowest hole in the shank and to a portion of the ripper assembly. The ripper assembly is then raised to raise the shank vertically. The bottom of the shank is then driven into the ground by lowering the ripper assembly and applying pressure to the chain loop pulling downward on the shank thereby depressing it into the ground. Again, much like the first method described above, this second method is also labor intensive, very dangerous (as the chain can give way) and is unpredictable.

Accordingly, the problem with installing an extended length shank within the ripper assembly of a crawler lies in the fact that the shank is taller in height than ripper assembly can raise the pocket. The conventional methods of installing a shank within the ripper assembly of a crawler are manual, time consuming, unpredictable (based on conditions in the field) and involve substantial risk of injury.

SUMMARY

Accordingly, a need has arisen to more efficiently, more speedily, more safely and more predictably install an extended length shank within a ripper assembly of a crawler. Moreover, a need has arisen to install an extended length shank onto the ripper assembly of a crawler that is not dependent on conditions of the field. It will become apparent to those skilled in the art after reading the detailed description of the present invention that the embodiments of the present invention satisfy the above mentioned needs.

According to one embodiment of the present invention, a rotating shank installer (RSI) is welded onto a ripper assembly of a crawler to allow effective installation of an extended length shank within the pocket of the crawler. The ripper assembly is raised or lowered and its pitch is altered by actions of hydraulic cylinders. The ripper assembly includes a pocket beam with at least one pocket for holding the shank. The ripper assembly can be multi-shank or single-shank.

In accordance with embodiments of the present invention, the RSI is welded to the rear surface of the pocket beam, at the center of the multi-shank beam. According to one embodiment, the RSI includes two brackets welded to the pocket beam, a first back plate welded to the brackets and a second back plate that is rotatively connected to the first back plate via a pin so that the second back plate can rotate with respect to the pocket beam. The second back plate is welded to two parallel plates that are spaced apart according to the thickness of the shank creating a rotating, open ended pocket. Each parallel plate comprises a hole aligned with the hole on the other plate. A shank may be securely held between the two parallel plates by inserting a pin through the holes of the parallel plates and a hole of the shank. A second set of aligned holes within the parallel plates can be used to prevent movement of the shank within the RSI by inserting another pin there through. Since the parallel plates are welded to the second back plate, they are free to rotate with respect to the pocket beam.

The RSI operates in the following manner to install an extended length shank within the pocket of the ripper assembly. First, a shank is positioned on the ground in a substantially horizontal position. The shank is laid over an article at one end such that its top portion is raised about one foot with respect to the ground. Since the RSI is attached to the pocket beam, it can be raised and lowered by the ripper assembly. Therefore, the ripper assembly lowers the RSI so that its parallel plates can be aligned with the shank, the crawler is moved backward in a fork-lift fashion so that the shank is positioned within the parallel plates. The shank is then secured within the RSI using two pins inserted within the holes of the parallel plates. The shank is attached at a position closer to its top so that the shank's bottom portion is heavier.

The ripper assembly with RSI is raised up which will rotate responsive to the weight imbalance of the shank. Accordingly, as the RSI is raised, the shank is moved from a horizontal position to a vertical position until the bottom of the shank lies just above the ground.

With the shank in a substantially vertical position within the RSI, the crawler is moved forward while the ripper assembly is lowered. This causes the bottom of the shank to be depressed into the ground and it rips a groove into the dirt. A stopper on the top of the RSI and a claw on the bottom of the RSI prevent the shank from exerting leverage on the pin holding the first and second back plates of the RSI. This prevents the RSI from being torn away from the pocket beam.

The shank is lowered by the ripper assembly until the top of the shank is below the maximum height that the ripper assembly can raise the pocket. At this point, the crawler stops moving forward and stops lowering the ripper assembly. The now vertical shank is disconnected from the RSI by removing the two pins, the machine then moves forward a couple feet, and advantageously, the shank is securely held in the ground by the groove that it ripped. The ripper assembly is now raised to accommodate the height of the factory pocket, backs up and then positions the pocket over the top of the shank and lowers the ripper assembly so that the shank can be properly inserted within the factory pocket.

Accordingly, using the RSI in the above method, an extended length shank is properly installed within a ripper assembly of a crawler in an efficient, safe and predictable fashion that does not rely on conditions of the field.

BRIEF DESCRIPTION OF THE DRAWINGS

Embodiments of the present invention are illustrated by way of example, and not by way of limitation, in the figures of the accompanying drawings and in which like reference numerals refer to similar elements and in which.

DETAILED DESCRIPTION

Reference will now be made in detail to embodiments of the present invention, examples of which are illustrated in the accompanying drawings. While the invention will be described in conjunction with these embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be evident to one of ordinary skill in the art that the present invention may be practiced without these specific details. In other instances, well known methods, procedures, components, and circuits have not been described in detail as not to unnecessarily obscure aspects of the invention.

Figure 1A:
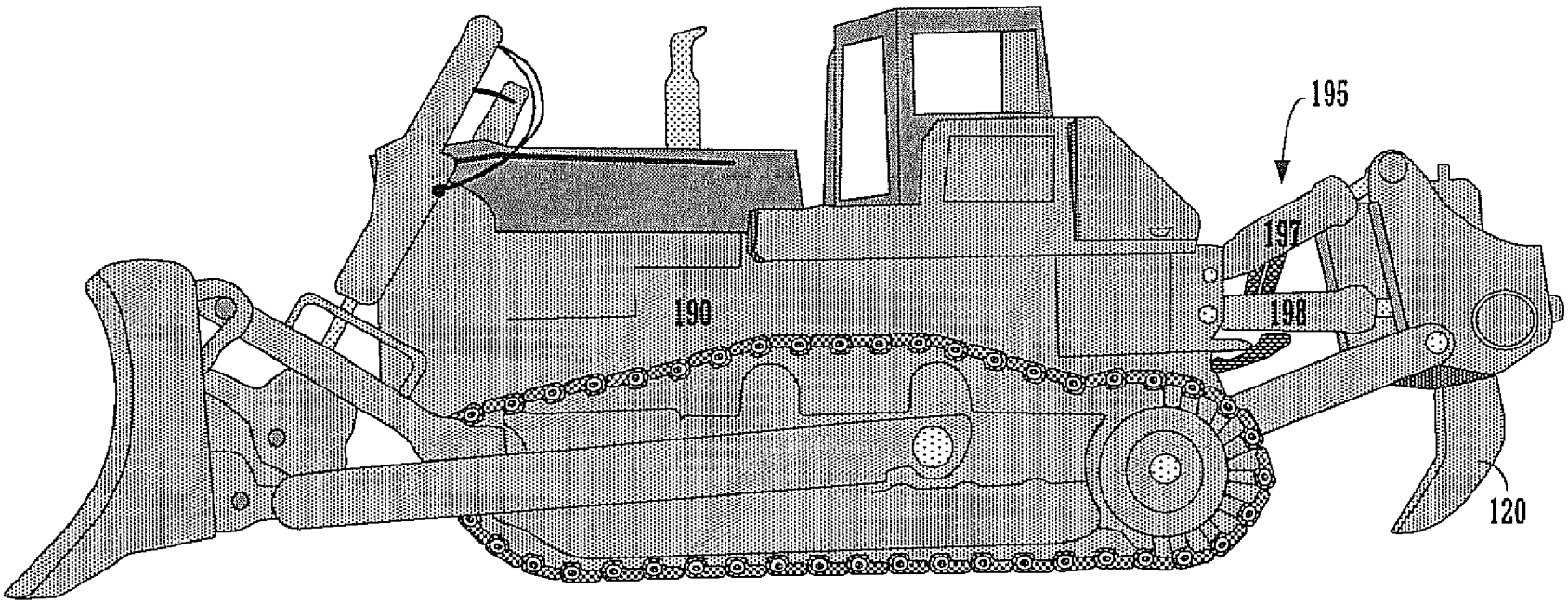
FIG. 1A illustrates a prior art crawler with a shank installed within a ripper assembly.
Figure 1B:
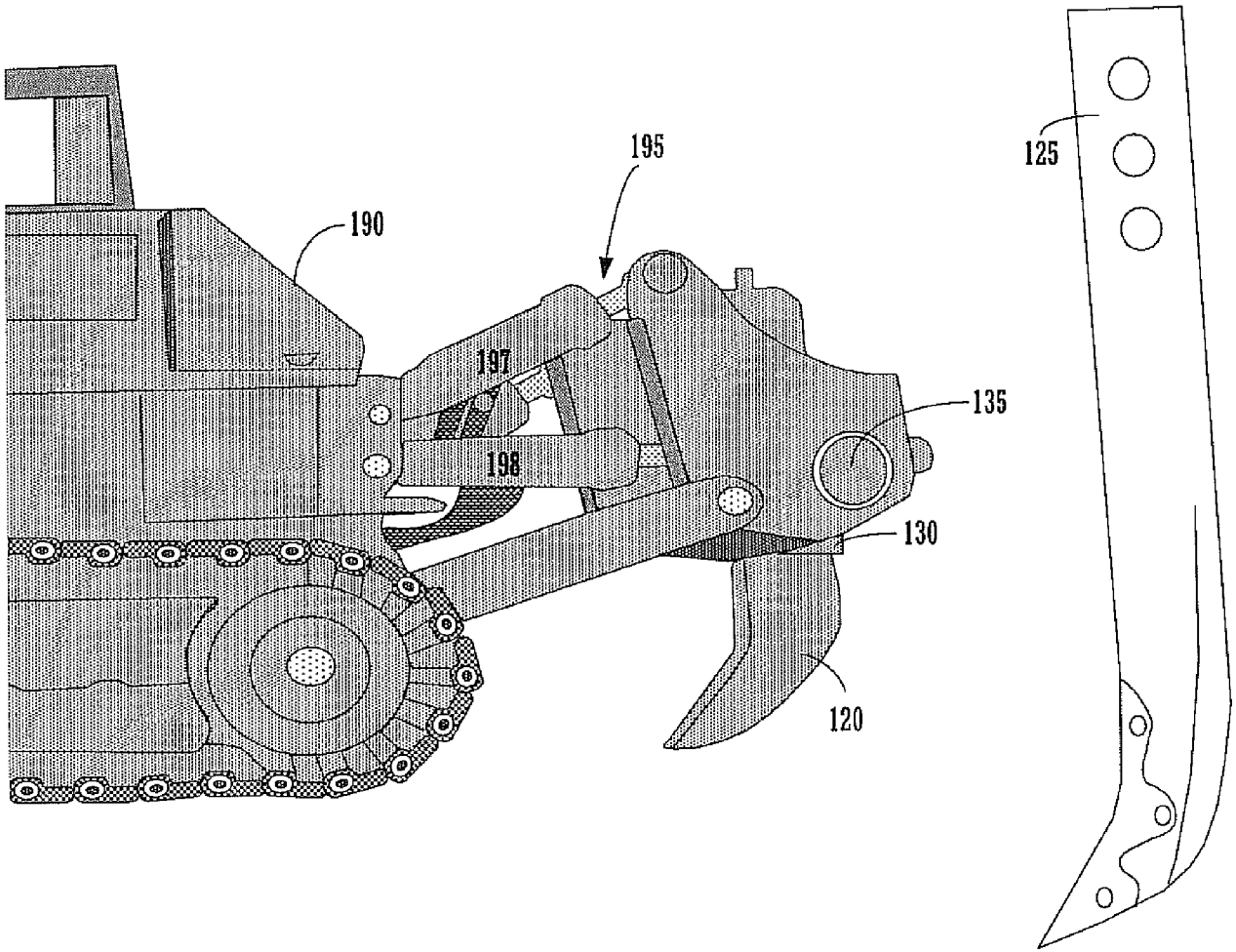
FIG. 1B illustrates the ripper assembly of the prior art crawler with an extended length shank shown adjacent.
Figure 2A:
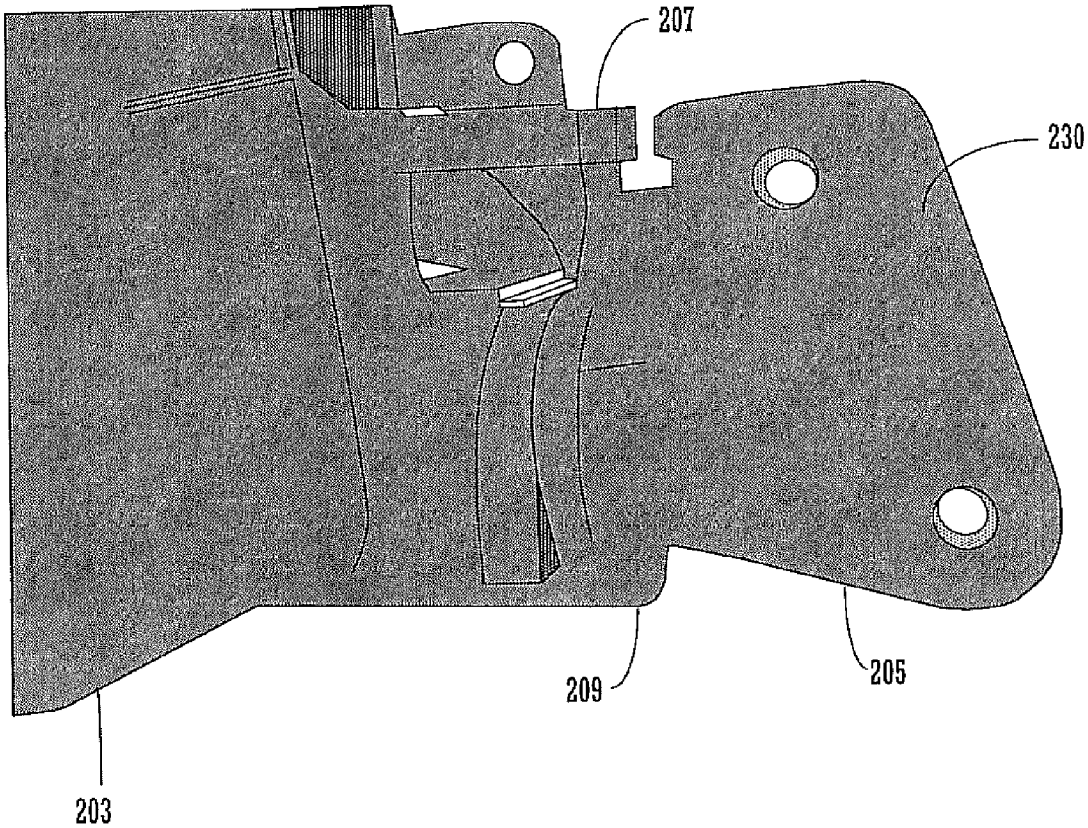
FIG. 2A illustrates a perspective view of the rotating shank installer of one embodiment of the present invention shown welded onto the front of a ripper assembly of a crawler.

Referring now to FIG. 2A, a perspective view of the rotating shank installer 205 of one embodiment of the present invention is shown welded onto the front of a ripper assembly of a crawler. The term "crawler" is the same as the term "tractor" and is used interchangeably throughout this patent application. The front of the ripper assembly of the crawler comprises a pocket beam 203. The pocket beam 203 is welded the rotating shank installer 205. Also shown welded is a claw 209 and a stopper 207.

It is appreciated that the pocket beam 203 may be raised or lowered and its pitch may be altered by actions of hydraulic cylinders that act on the pocket beam 203. Accordingly, the rotating shank installer 205 is raised or lowered as the pocket beam 203 is raised or lowered. In accordance with embodiments of the present invention, the rotating shank installer is intended to hold a shank within parallel plates 230. When a shank is installed, the claw 209 and the stopper 207 prevent the shank from exerting leverage within the installer 205.

Figure 2B:
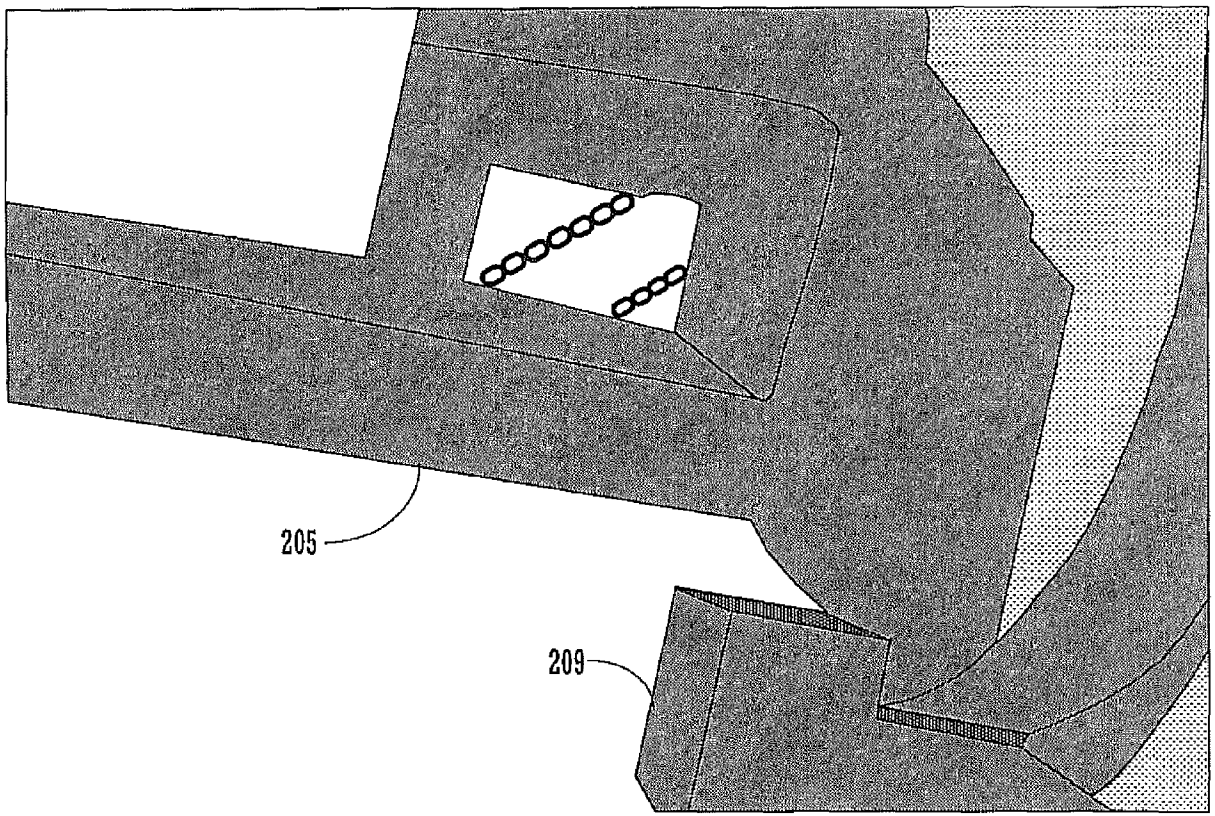
FIGS. 2B and 2C illustrate perspective views of the rotating shank installer in accordance with one embodiment of the present invention so that the claw support member is shown.
Figure 2C:
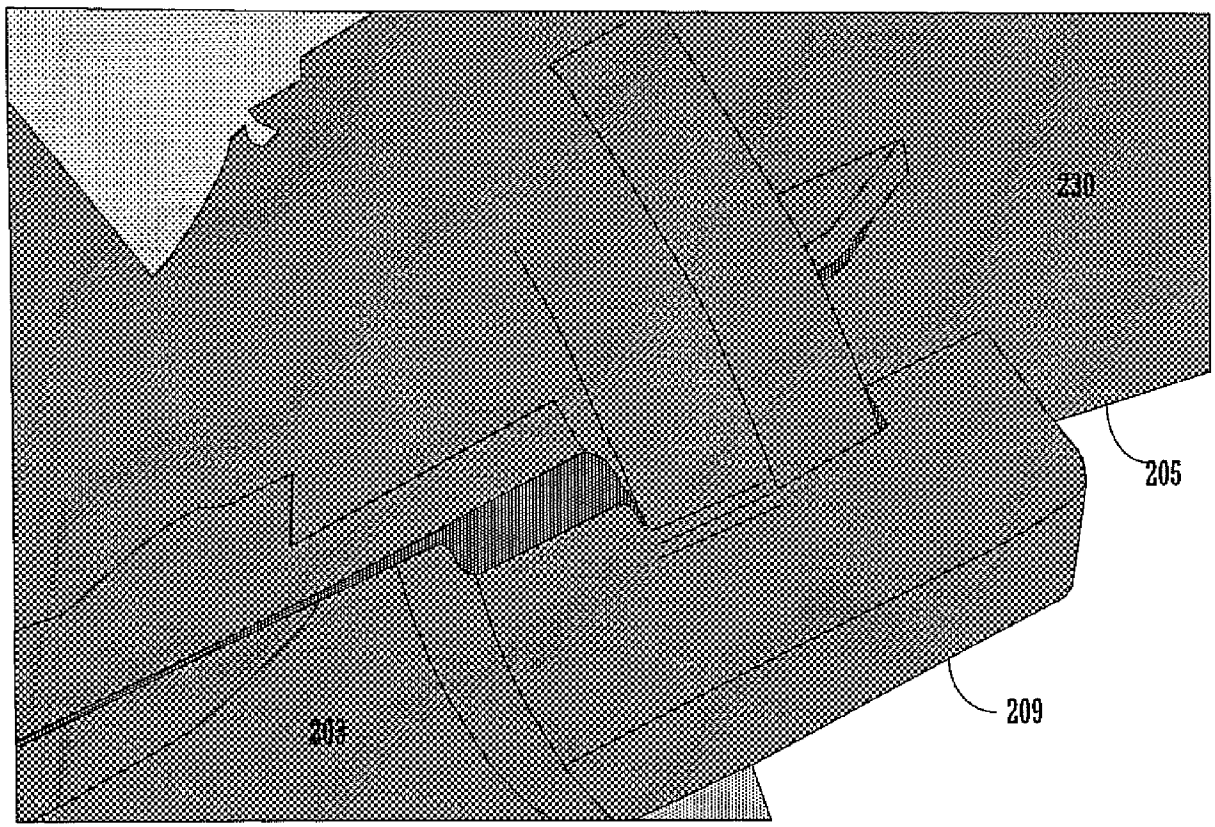

FIGS. 2B and 2C are perspective views of the rotating shank installer 205 in accordance with one embodiment of the present invention with the claw 209 support member shown. The claw 209 may be welded to the pocket beam 203 as well as being welded to a back plate of the rotating shank installer 205, as shown by FIG. 2C.

Figure 2D:
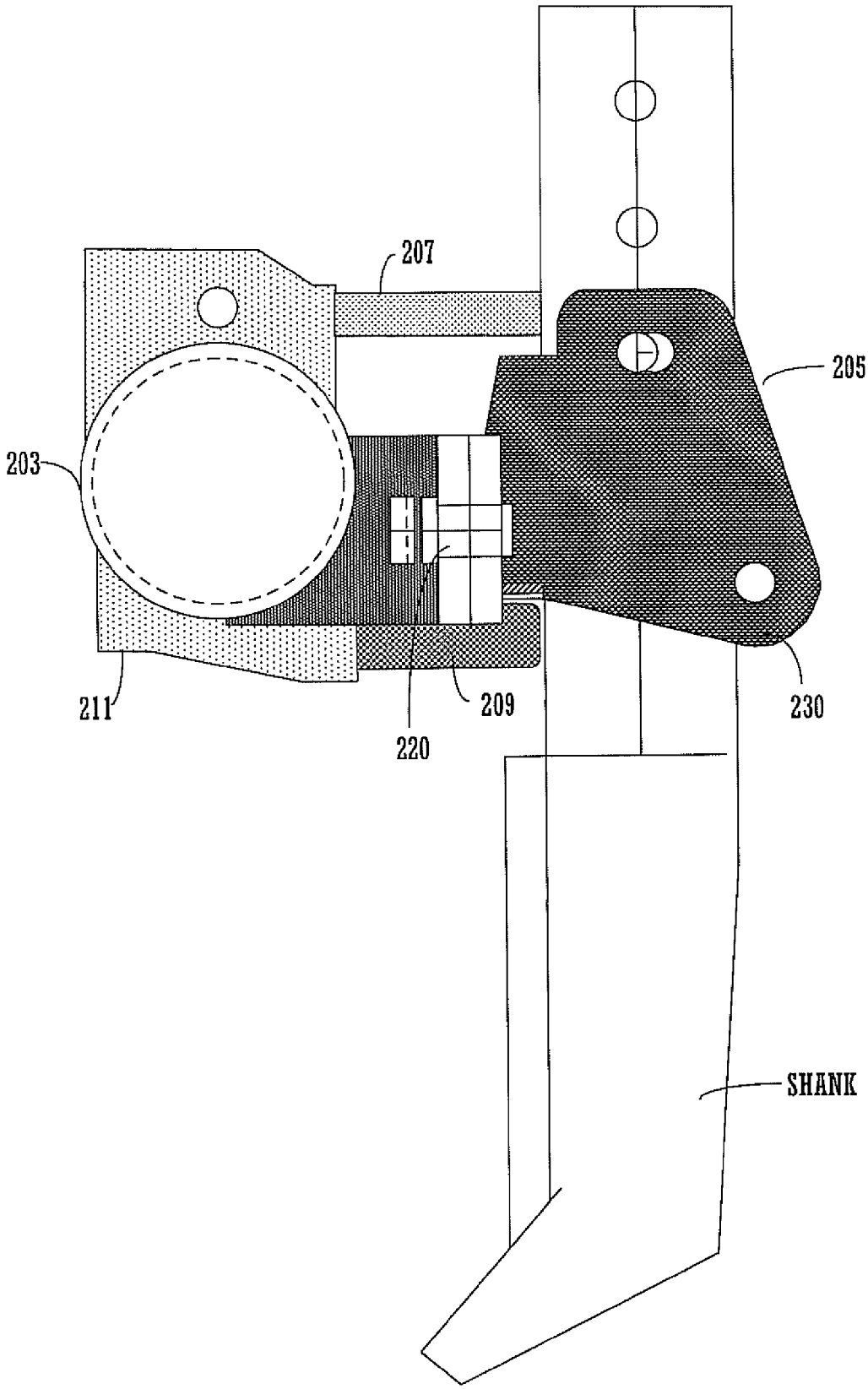
FIG. 2D illustrates side view of the rotating shank installer welded onto a pocket beam of a ripper assembly and also having installed therein a shank.

Referring now to FIG. 2D, side view of the rotating shank installer 205 is shown as welded onto the pocket beam 203 of a ripper assembly and also having installed therein an extended length shank. The pocket beam 203 comprises a pocket 597 for holding the shank. The rotating shank installer 205 is coupled to the pocket beam 203, e.g., welded. The rotating shank installer 205 is operable to securely hold the shank within plates 230. For example, the rotating shank installer 205 comprises two parallel plates 230 (described in FIGS. 2E and 2F) for holding the shank. The shank is held in place by (1) inserting a pin through the center holes of the parallel plates, through the shank and by (2) inserting another pin through the edge located holes of the parallel plates 230.

The pocket beam 203 and the pocket 597 further include claw 209 and stopper 207, as described above. The claw is welded to components of the rotating shank installer and also to the pocket 597. The stopper 207 is welded to the pocket 597. As presented above, the stopper 207 and the claw 209 prevent the shank from exerting leverage on pin 220 that holds the back plates of the rotating shank installer 205 when the crawler moves forward while holding the shank in place. Thus, the stopper 207 and the claw 209 prevent the rotating shank installer 205 from snapping away from the pocket 597 and the pocket beam 203.

Figure 2E:
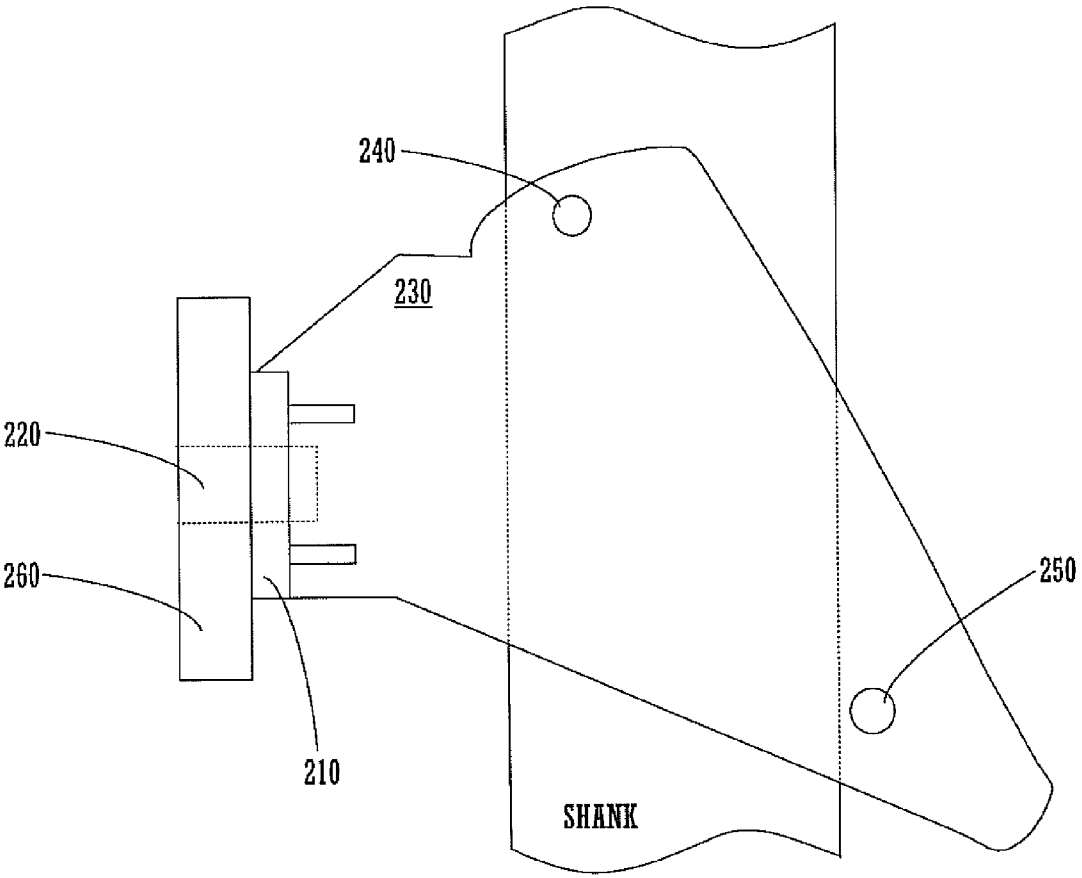
FIGS. 2E and 2F show the rotating shank installer in accordance with one embodiment of the present invention.
Figure 2F:
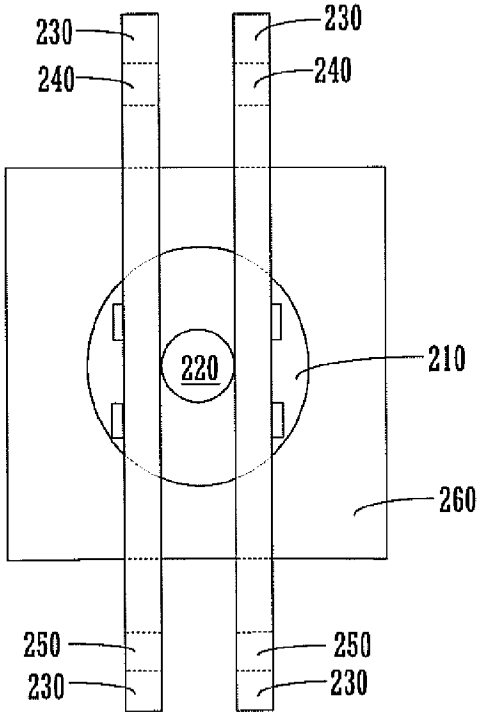

Referring now to FIGS. 2E and 2F, a rotating shank installer in accordance with one embodiment of the present invention is shown. FIG. 2E shows a side view of the rotating shank installer in accordance with one embodiment of the present invention. FIG. 2F shows a front view of the rotating shank installer in accordance with one embodiment of the present invention. With respect to FIGS. 2E and 2F, the plates 230 are free to rotate clockwise or counter-clockwise.

The rotating shank installer includes a first back plate 260 that is for connection to a crawler. For example, the first back plate 260 may be welded to the front of the pocket beam of a crawler. However, it is appreciated that the first back plate 260 may be coupled to the pocket beam 203, via other fastening means, e.g., bolts, screws, etc. The rotating shank installer further includes a second back plate 210 that is rotatively coupled to the first back plate 260. The second back plate 210 is coupled to the first back plate 260 via a fastening mechanism 220, e.g., a bolt or a pin. The second back plate 210 is therefore rotatable with respect to the first back plate 260 while the first back plate 260 remains fixed. The second back plate 210 is connected to at least two parallel plates 230.

The two parallel plates 230 are configured to sandwich a shank in between them. Each of the parallel plates 230 may include two holes 240 (center) and 250 (edge). The first holes 240 on each of the parallel plates 230 are structurally aligned with one another and, in operation, are to be manually aligned with a hole on the shank when the shank is positioned between the plates. The shank is secured by inserting a pin in the holes 240 of the parallel plates 230 through the hole of the shank. It is appreciated that the pin has an elongated portion to go through the holes of the respective parallel plates and the hole of the shank while its base has a larger diameter with respect to the holes in order to prevent the pin from falling through the holes, thereby securing the shank. Moreover, the pin may have a counterpart component to secure the shank from both sides, similar to a screw and nut counterpart.

It is appreciated that the second hole 250 on each of the respective parallel plates 230 can be used to secure the edge of the shank (as would the bottom edge of the rear side of the factory pocket) as shown in FIG. 2E. For example, the hole 250 on each of the respective parallel plates 230 are structurally aligned with one another and they are positioned along the edge of the shank. In other words, each of the respective holes 250 is offset from the shank, where the shank is shown in the vertical position. When the shank is pinned using hole 240 and hole 250, the shank is prevented from twisting counter-clockwise when the crawler is moved forward, e.g., to the left with respect to FIG. 2E. In one embodiment, the rotating shank installer is manufactured from strong material, e.g., steel, operable to securely hold the heavy shank.

Figure 2G:
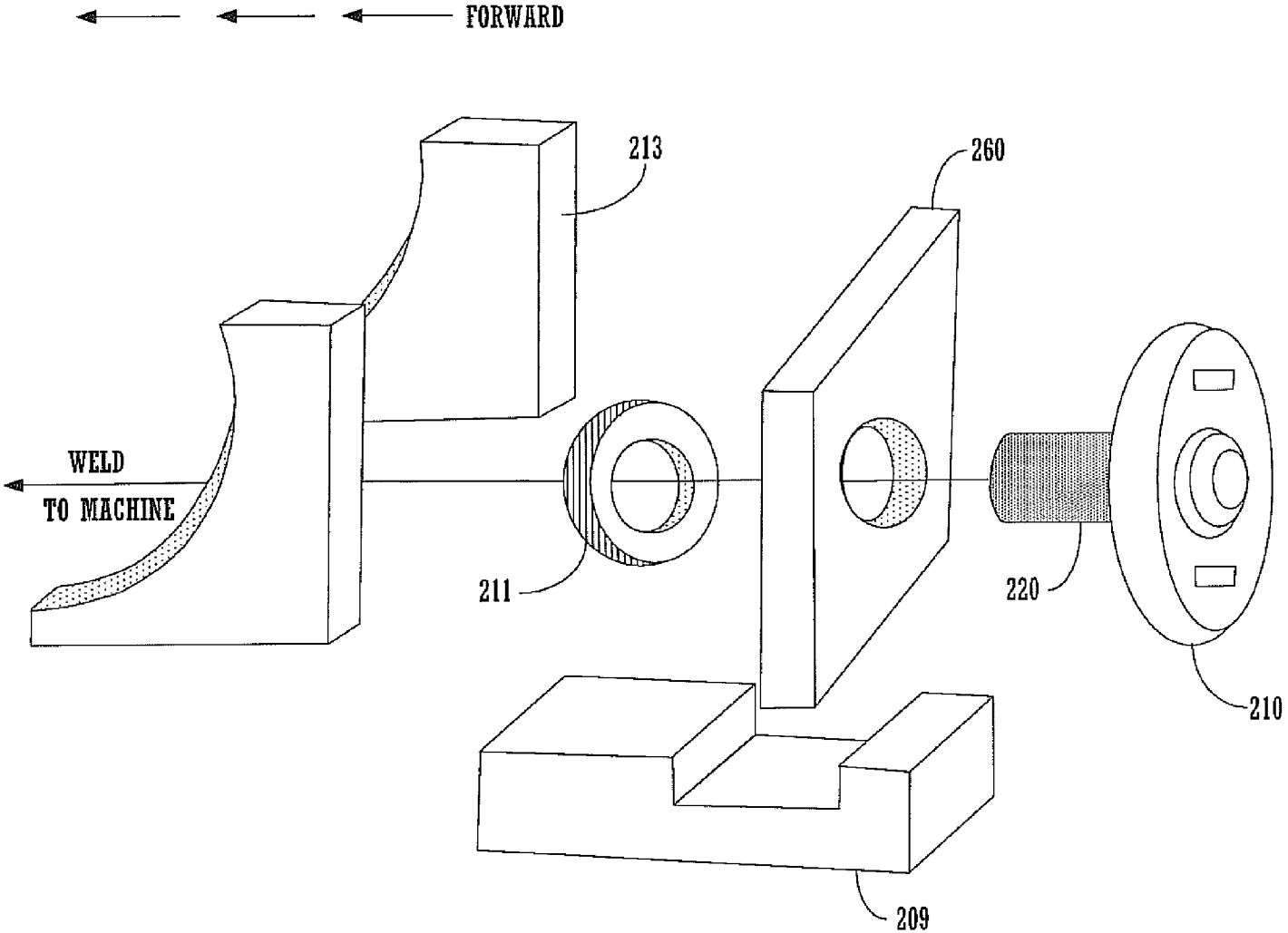
FIG. 2G illustrates an exploded view of some of the component parts of the rotating shank installer in accordance with one embodiment of the present invention.
Figure 2H:
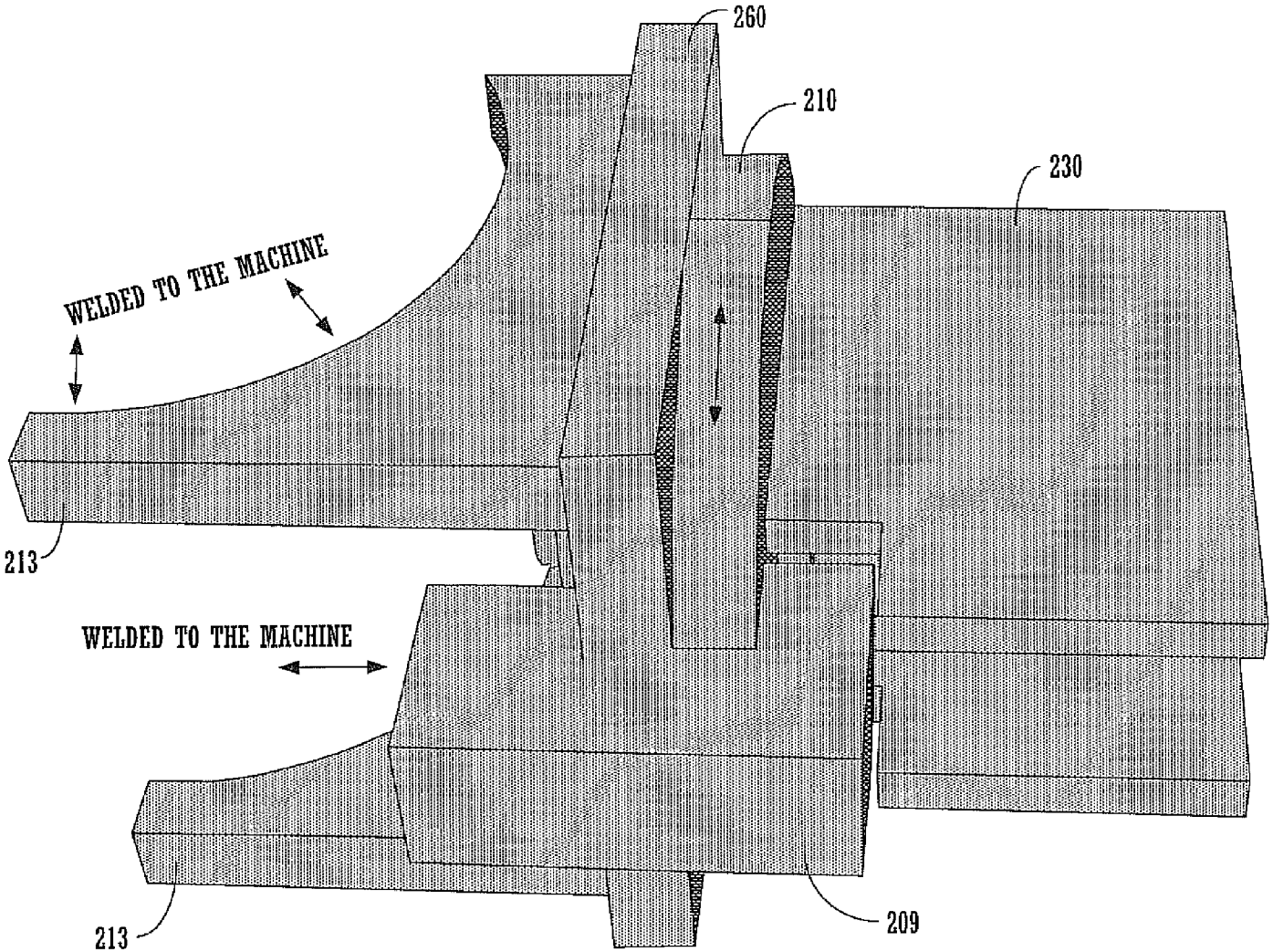
FIGS. 2H and 2I illustrate assembled view of the rotating shank installer in accordance with one embodiment of the present invention.
Figure 2I:
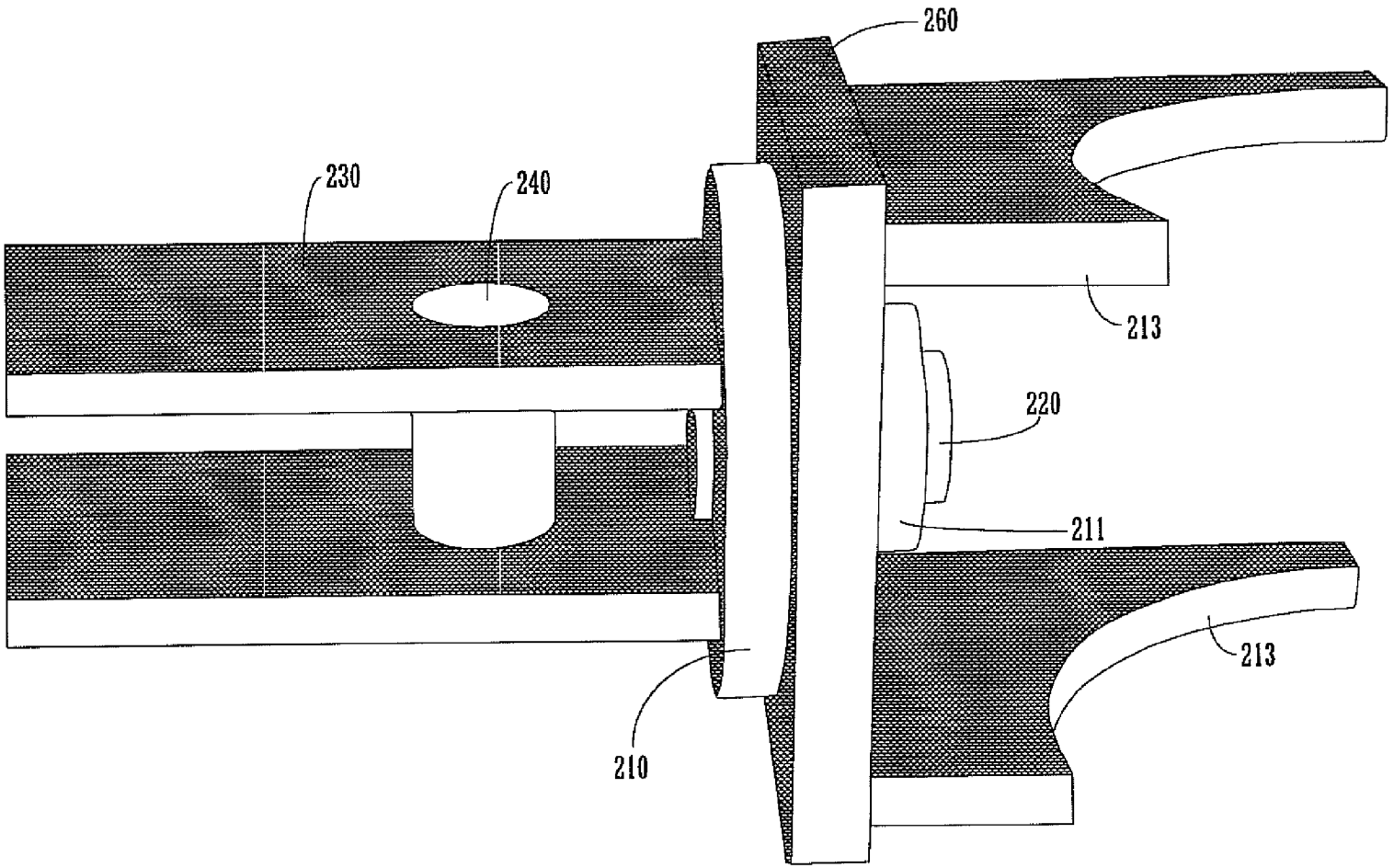

FIG. 2G illustrates an exploded view of some of the component parts of the rotating shank installer in accordance with one embodiment of the present invention. The second back plate 210 is coupled to the first back plate 260 via a pin 220 and a collar 211 that is welded to the pin to share the straight outward tension that comes from the shank. It is appreciated that the collar 211 is welded to the pin 220 when the pin 220 is inserted into the second back plate 210, thereby preventing it from coming out and have movement. The first back plate 260 is welded to two plates 213 that are directly welded to pocket beam (not shown) vertically parallel to the existing pocket. The claw 209 is positioned under the first and the second back plates 210 and 260 in order to prevent the shank from exerting leverage on the pin 220 and/or plate 210. The claw 209 is also welded to the existing pocket. It is appreciated that the first back plate 260 and the second back plate 210 are placed inside the claw 209. Moreover, it is appreciated that the first back plate 260 may be welded to the two plates 213, which is further welded to the circular beam to form a strong base. Referring now to FIGS. 2H and 2I, assembled perspective of the rotating shank installer in accordance with one embodiment are shown.

Figure 3A:
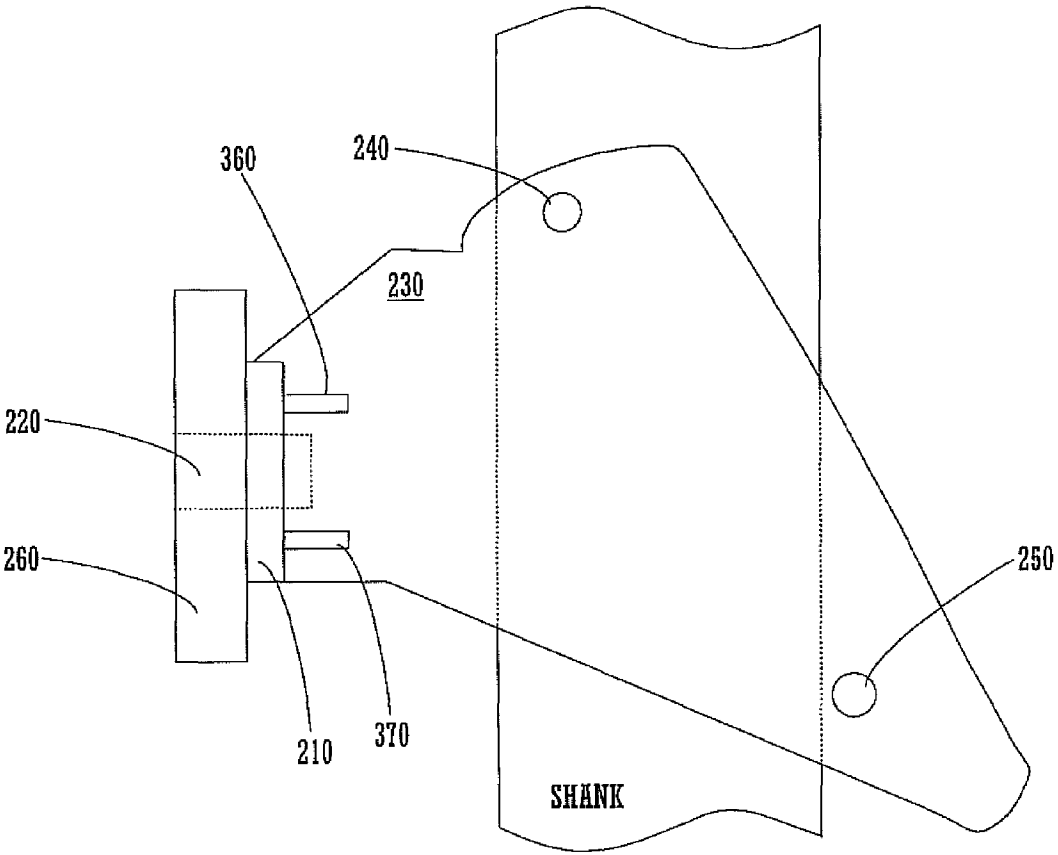
FIGS. 3A and 3B, show a rotating shank installer with a support component in accordance with one embodiment of the present invention.
Figure 3B:
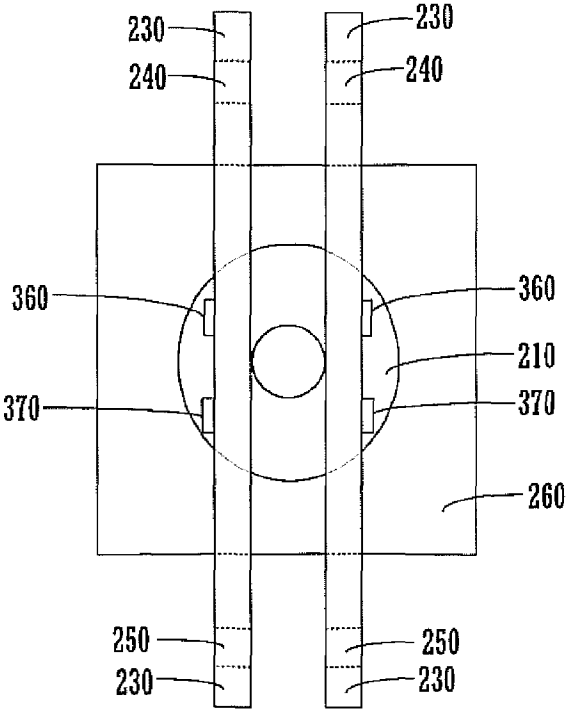

FIG. 3A shows a side view of a rotating shank installer with a support component in accordance with one embodiment of the present invention. FIG. 3B shows a front view of the rotating shank installer with a support component in accordance with another embodiment of the present invention. FIGS. 3A and 3B show a rotating shank installer substantially similar to that of FIGS. 2E and 2F. The rotating shank installer in accordance with FIGS. 3A and 3B, however, includes a first supporting component 360 and a second supporting component 370. The first supporting component 360 and the second supporting component 370 provide further support to the parallel plates 230 to securely hold the heavy shank without bending or snapping away. In one embodiment, the first supporting component 360 and the second supporting component 370 comprise steel. The supporting components 360 and 370 may have any shape, e.g., triangular. As such, the shape of the supporting components 360 and 370 are exemplary and not intended to limit the scope of the present invention.

Figure 4:
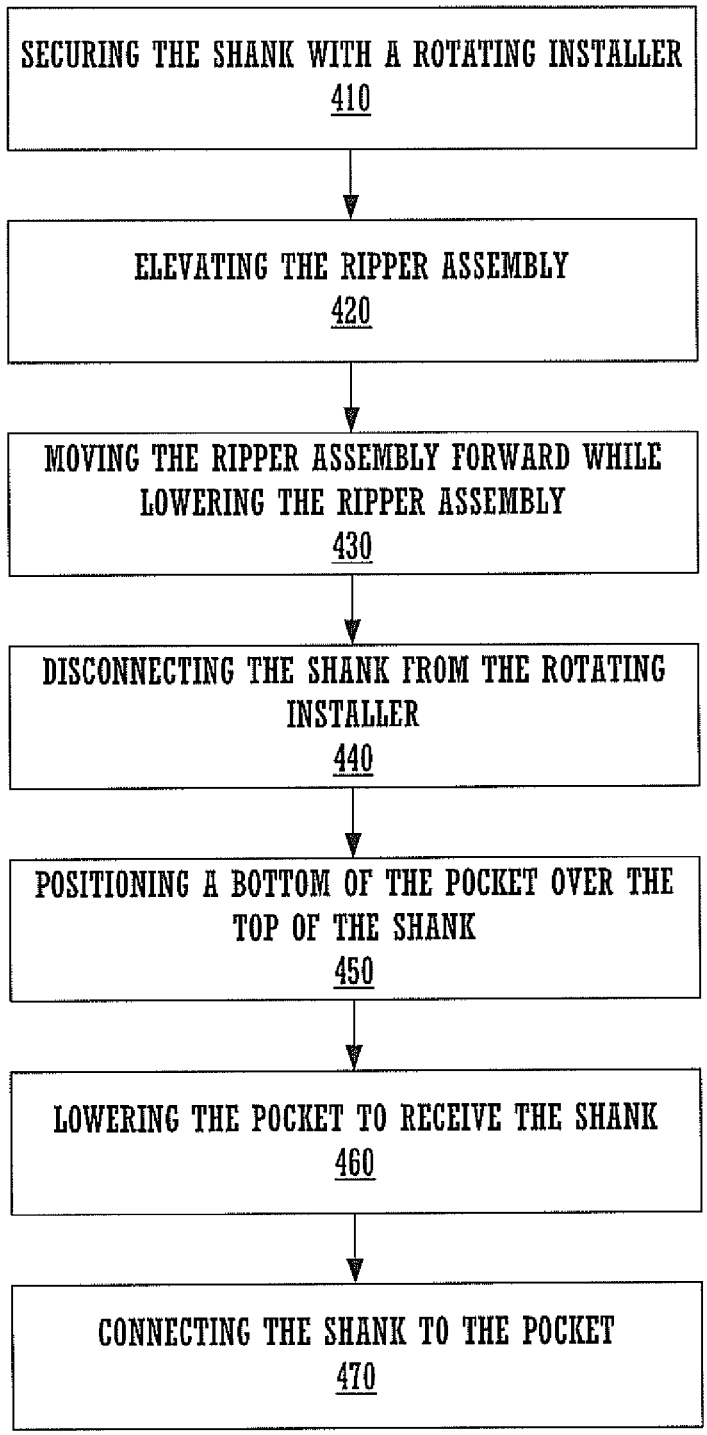
FIG. 4 shows an exemplary flow diagram of a method for installing a shank into a ripper assembly of a crawler in accordance with one embodiment of the present invention.
Figure 5A:
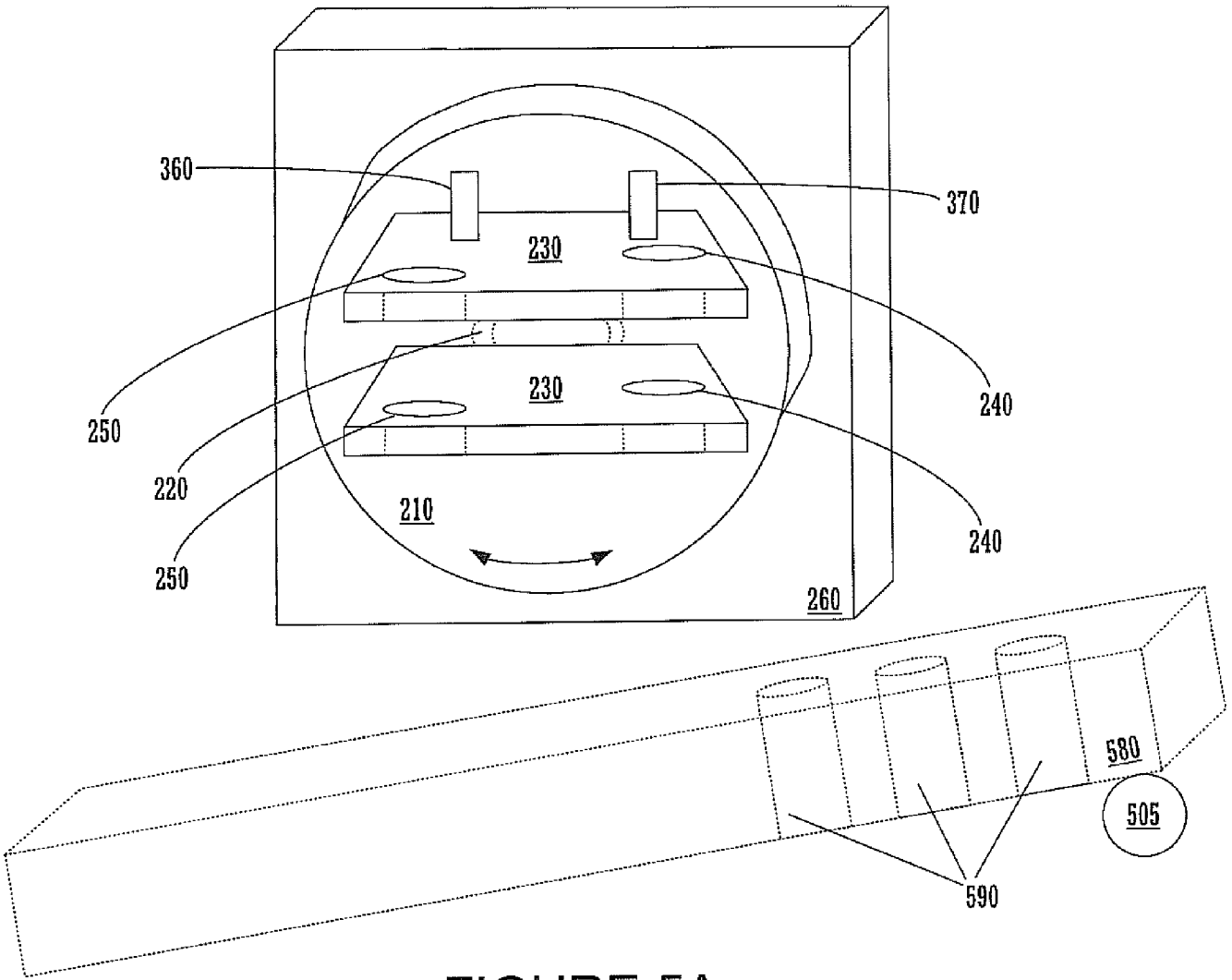
FIGS. 5A, 5B, 5C, 5D, 5E, 5F, 5G, and 5H show diagrams of a system for installing a shank onto a ripper assembly of a crawler in accordance with one embodiment of the present invention.

Referring now to FIGS. 4 and 5A-5H a method and apparatus for installing an extended length shank 580 onto a ripper assembly in accordance with one embodiment of the present invention are shown. At step 410 of process 400, the shank 580 is secured within the rotating installer. The shank 580 is laid down over an article at one end such that its top portion is raised about one foot with respect to the ground with respect to the ground with the end 580 (having holes 590) positioned off the ground as shown in FIG. 5A. In one exemplary embodiment, the shank 580 can be placed over a block 505 in order to elevate one end of the shank 580 with respect to the ground.

Figure 5B:
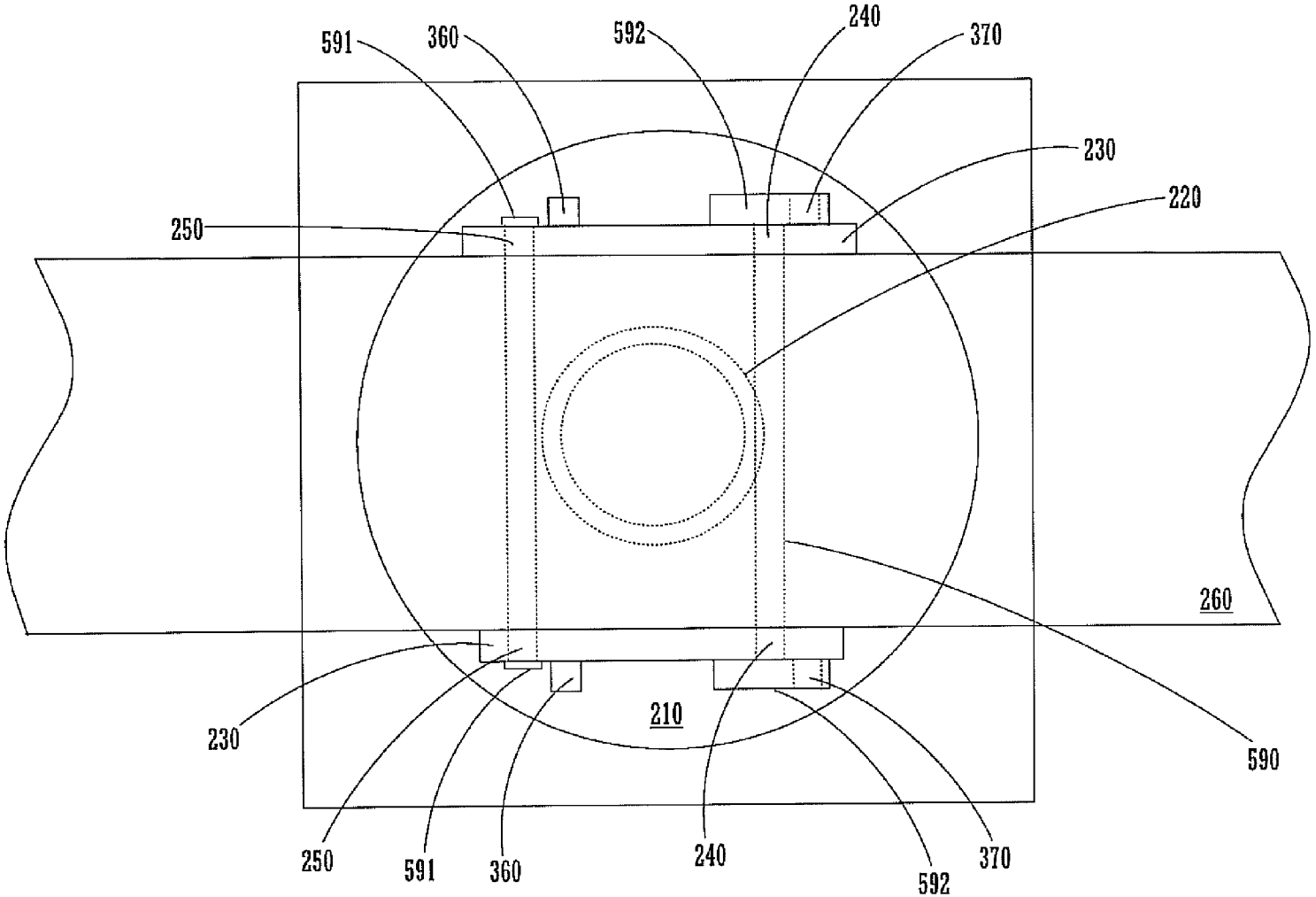
Figure 5C:
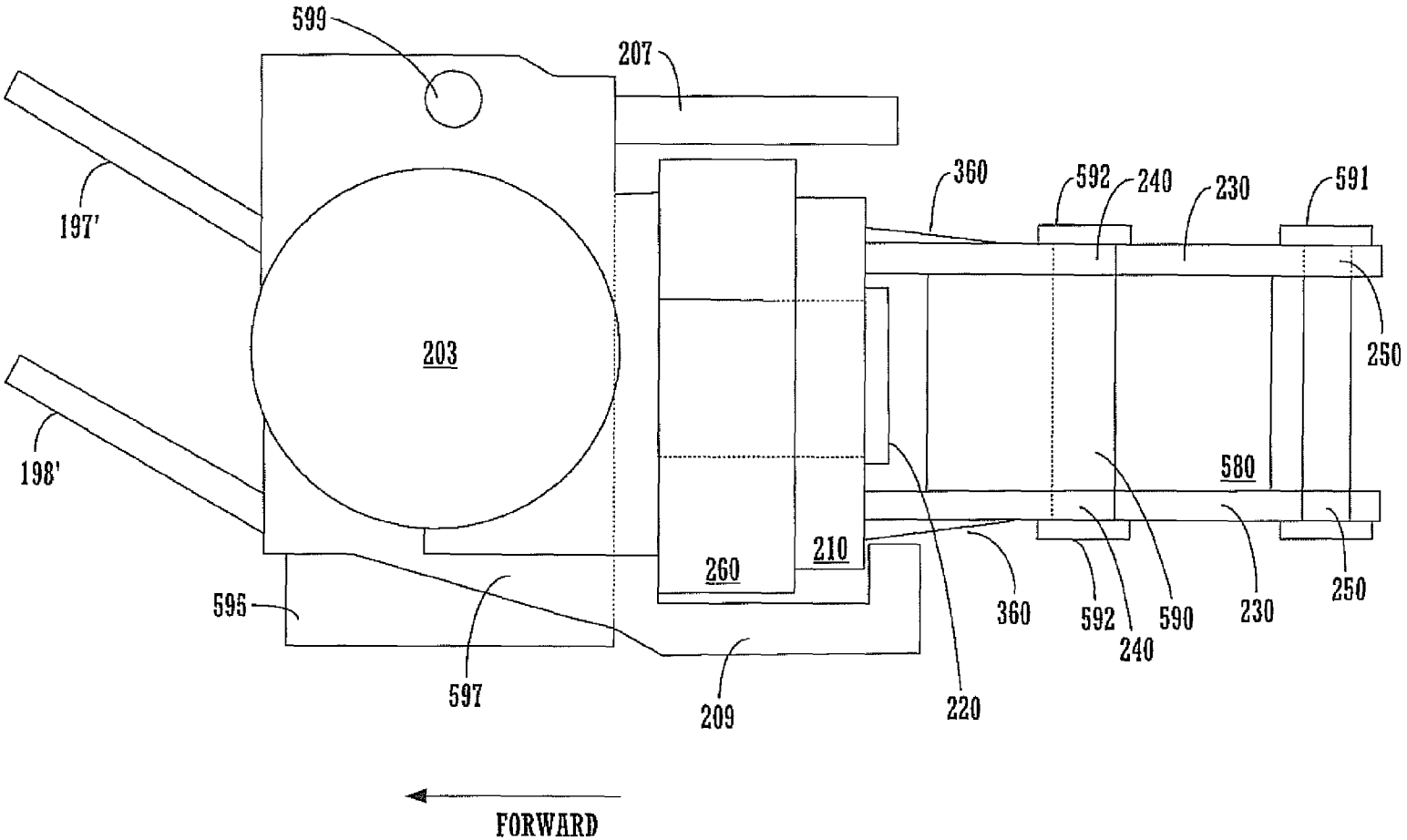

According to one embodiment, the plates of the rotating shank installer are lowered and tilted to match the elevation of the shank and then positioned to sandwich the shank 580. The holes 240 are aligned with a center hole 590 of the shank 580. As shown in FIGS. 5B and 5C, a pin 592 is inserted in the holes 240 once aligned with hole 590, thereby securing the shank 580. Furthermore, a pin 591 is inserted in the holes 250, thereby securing the shank 580 further and preventing the shank 580 from rotating counter clockwise when the rotating shank installer is moved forward, e.g., to the left in FIG. 5E.

It is appreciated that at step 410 the rotating shank installer secures the shank 580 at a position that is off of its center of gravity allowing the shank 580 to pivot when raised by the rotating shank installer. The lower half of the shank is selected to be the heavy side so that the shank rises with its bottom toward the ground. It is appreciated that the shank pivots when it is raised because the second back plate 210 is free to rotate.

Referring now to FIG. 5C, a side view of a system securing the shank 580 in accordance with one embodiment is shown. The first back plate 260 is connected to the front side of the pocket 597. The first back plate 260 is first attached to two plates 213 which is further attached to the beam. The stopper and the claw may be attached to the pocket that is coupled to the pocket beam 203. The pocket beam 203 is coupled to the crawler. The pocket beam 203 is raised or lowered using the hydraulic cylinders 197' and 198'.

The pocket 597 of the crawler is the component that the shank 580 is ultimately intended for. The pocket 597 has a shaft 595 for receiving the shank 580. For example, the hole 590 of the shank 580 is to be aligned with a hole 599 of the pocket 597. As a result, the shank 580 may be secured and held vertically by the pocket 597. A groove several feet deep may be created when the shank 580 is vertically secured by the pocket 597 and when moved by the crawler.

Figure 5D:
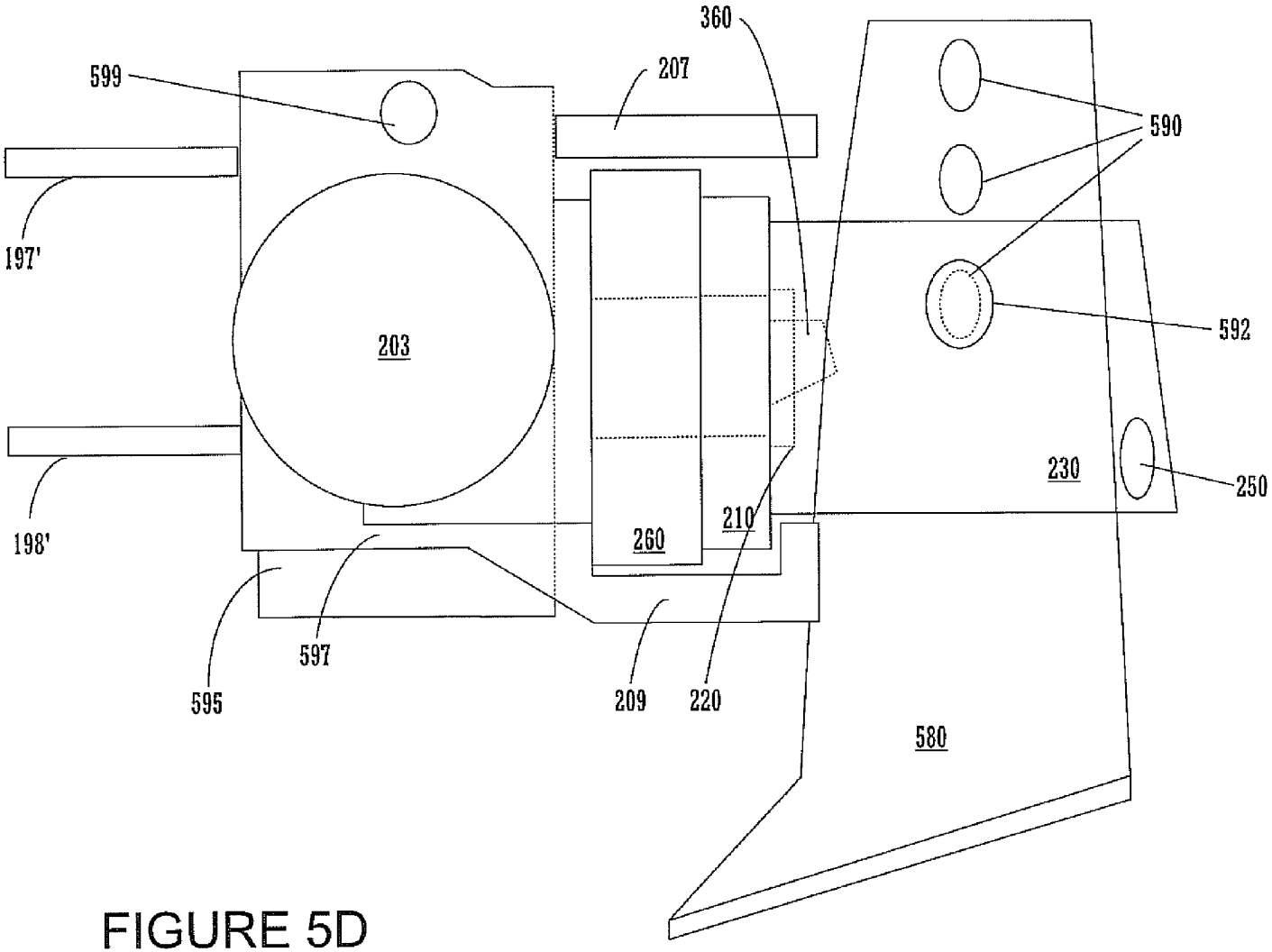
Figure 5E:
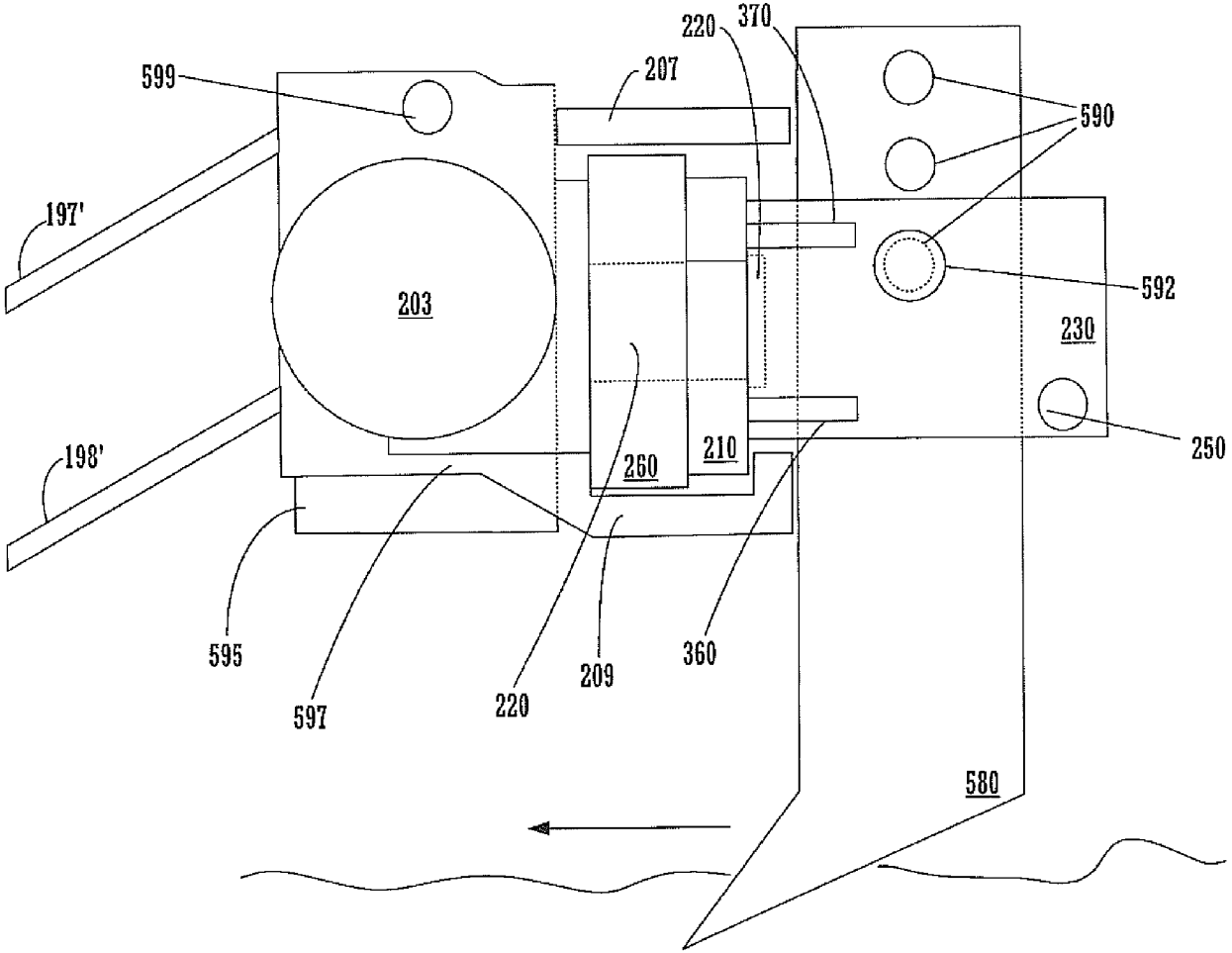

At step 420 of FIG. 4, the rotating shank installer outfitted with the shank is slowly elevated from the low level to its high level. For example, the hydraulics 197' and 198' cause the pocket beam 203 and attached the rotating shank installer to be raised, as shown by FIG. 5D. Raising the rotating shank installer causes the second back plate 210 to rotate under the weight of the shank. The shank 580 pivots and causes the second back plate 210 to rotate because the shank 580 is secured somewhere off its center of gravity, thereby causing its weight to pivot as the pocket beam 203 is raised. Referring to FIG. 5E, the rotation continues until the shank 580 is held substantially vertically with respect to the ground and lifted off the ground.

Figure 5F:
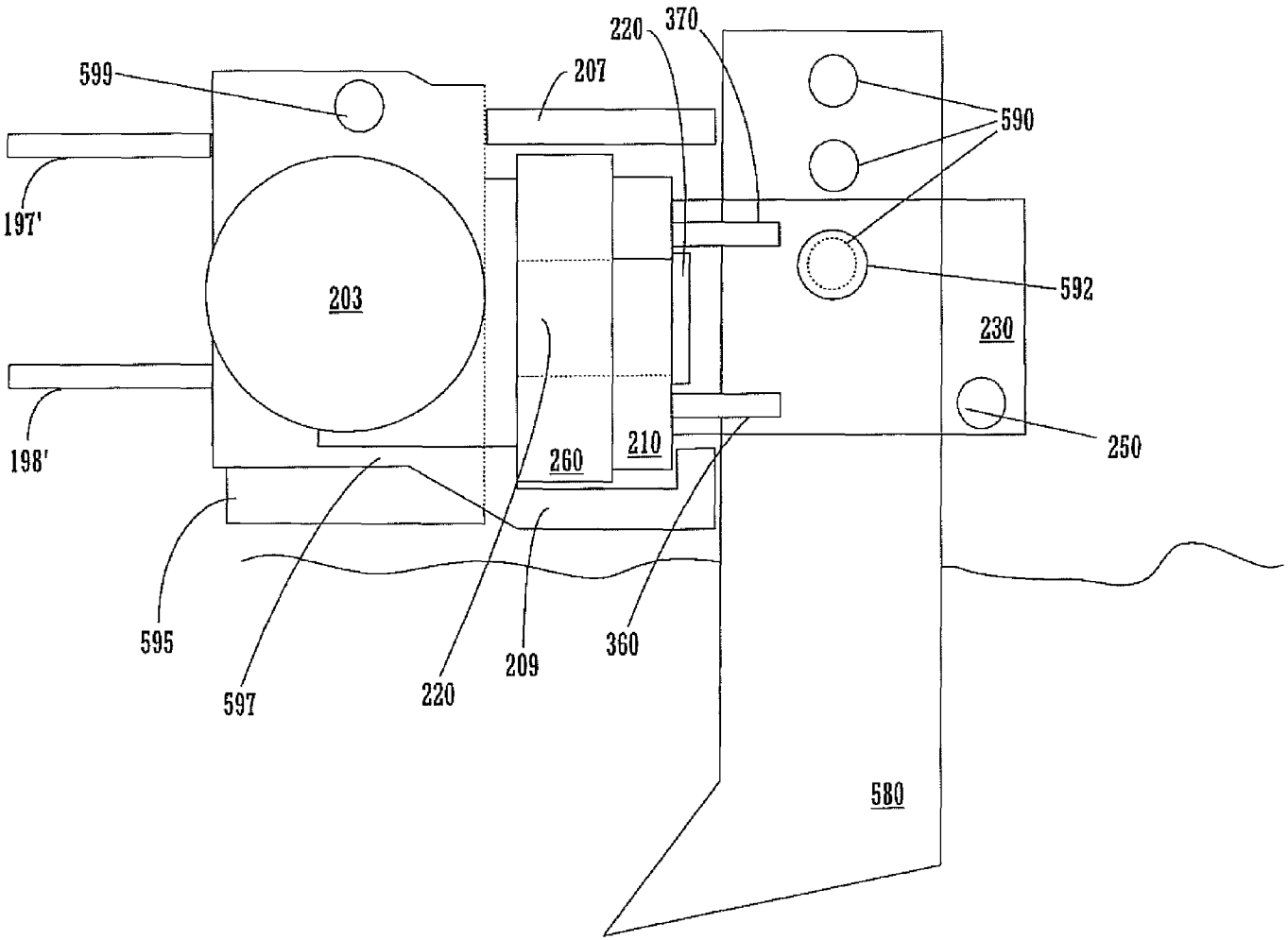

At step 430, the crawler is moved forward while lowering the ripper assembly. For example, once the shank 580 is vertically held by the rotating shank installer, the crawler moves forward and the hydraulics 197' and 198' are lowered, thereby lowering the rotating shank installer, as shown by FIG. 5F. A groove is created when the shank 580 engages the ground and is moved forward by the crawler. The crawler holding the shank 580 is moved and rips a groove until the top of the shank 580 is at a height above the ground that is below the maximum height to which the pocket 597 can be raised by the ripper assembly. The created groove secures the shank 580 in the ground in a vertical position, see FIG. 5F.

As the shank rips the grove at step 430, the stopper 207 and the claw 209 apply pressure to the shank 580 and the second back plate 210 in order to prevent the shank 580 from exerting leverage on the pin 220 holding the first and the second back plates. This prevents back plate separation.

Figure 5G:
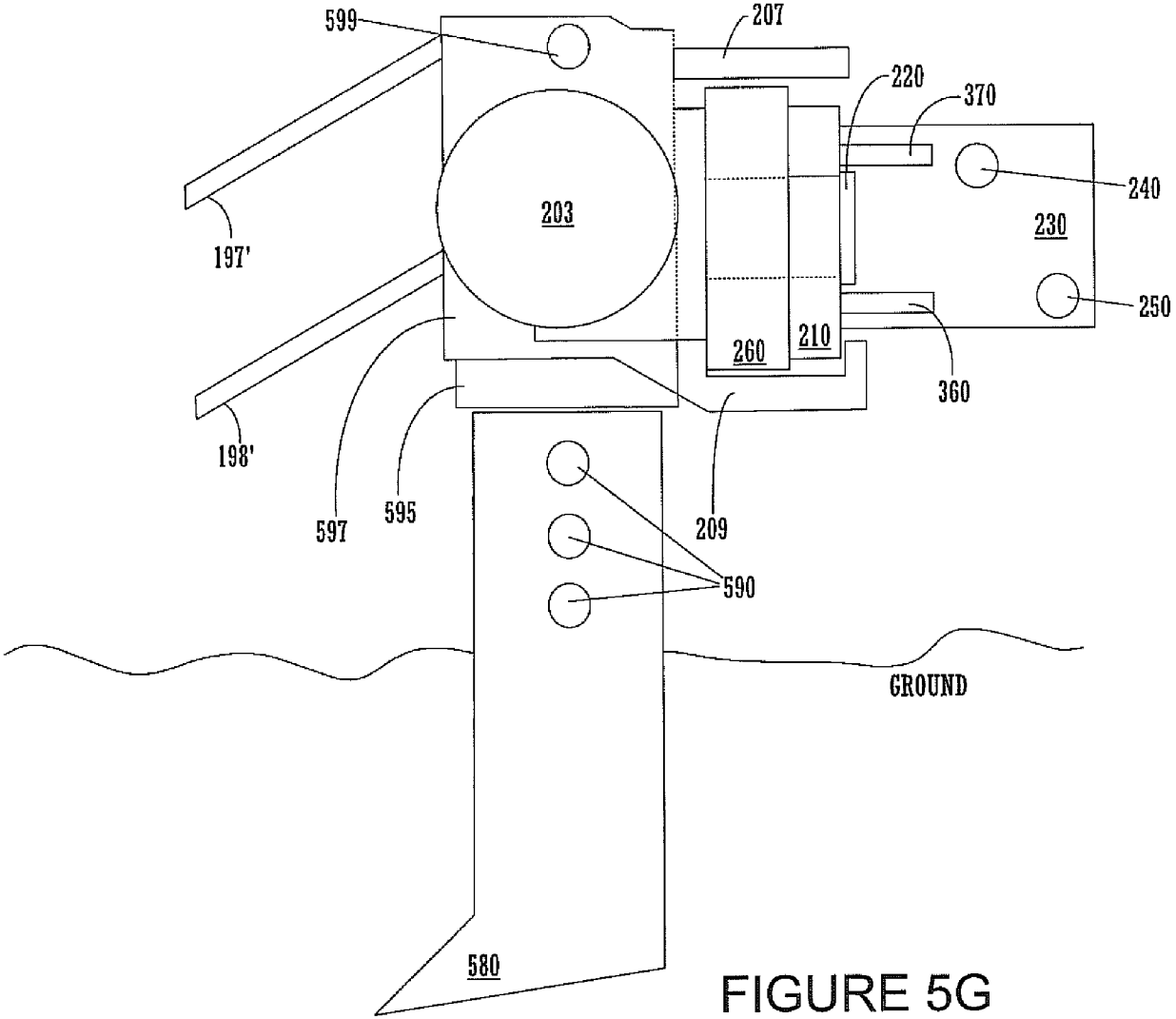

At step 440, the rotating shank installer is disconnected from the shank 580. For example, pins 591 and 592 may be removed and the groove securely holds the shank 580 vertically in the ground. The pocket beam 203 is then raised by adjusting the hydraulics 197' and 198', thereby raising the rotating shank installer. At step 450, the bottom of the pocket 597 is positioned over the top of the shank 580, as shown by FIG. 5G.

Figure 5H:
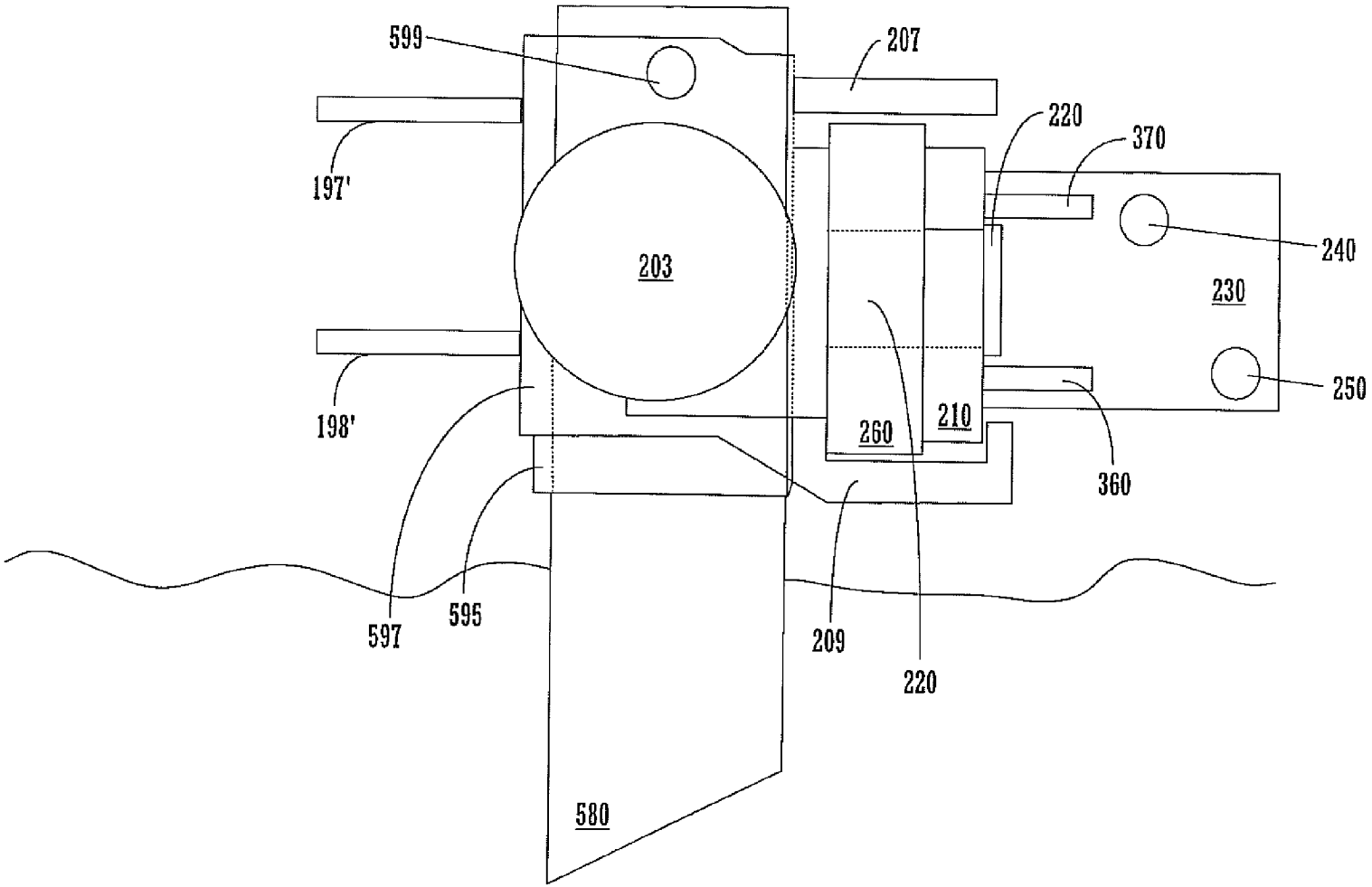

At step 460, the ripper assembly is lowered so that the shank 580 enters the pocket 597, as shown by FIG. 5H. For example, the hydraulics 197' and 198' are adjusted to lower the pocket beam 203, thereby lowering the pocket 597 and the shaft 595.

At step 470, the shank 580 is connected to the pocket 597. For example, the pocket 597 may now engage the shank 580 and secure the shank 580 in place by inserting a pin the holes 599 and 590, as shown by FIG. 5H. At this point, the shank 580 is securely and safely installed on the pocket 597 of the crawler.

Accordingly, the crawler may now move and rip a groove several feet deep. The use of the rotating shank installer in accordance with embodiments of the present invention enables the shank to be efficiently loaded to the crawler without being dependent on the conditions of the field and while minimizing risk of worker injury.

It is appreciated that the shank can be removed from the crawler by following the steps of FIG. 4 in reverse order. In one embodiment, after the pin is removed, the shank is pulled out of the ground with a chain and leaves it for transport to move it using the ripper beam to lift.

In the foregoing specification, embodiments of the invention have been described with reference to numerous specific details that may vary from implementation to implementation. Thus, the sole and exclusive indicator of what is, and is intended by the applicants to be, the invention is the set of claims that issue from this application, in the specific form in which such claims issue, including any subsequent correction. Hence, no limitation, element, property, feature, advantage or attribute that is not expressly recited in a claim should limit the scope of such claim in any way. The specification and drawings are, accordingly, to be regarded in an illustrative rather than a restrictive sense.

What is claimed is:

1. A method of installing an extended length shank within a ripper assembly, said method comprising:

with said shank in a substantially horizontal position with respect to the ground, securing said shank within a rotating installer wherein said rotating installer is rotatively connected to the ripper assembly;

elevating said ripper assembly causing said shank to rotate within said rotating installer to a substantially vertical position;

moving said ripper assembly forward while lowering said ripper assembly to cause said shank to rip a groove in the ground and become lowered therein until a top of said shank is at a height above the ground that is below a maximum height of a pocket of said ripper assembly;

disconnecting said shank from said rotating installer wherein said shank is held in place by said groove;

positioning a bottom of said pocket over said top of said shank and lowering said pocket to receive said shank; and connecting said shank to said pocket.

2. A method as described in claim 1 wherein said rotating installer comprises two parallel plates each comprising a first hole aligned with each other and operable to be aligned with a hole of said shank and wherein further said securing comprises positioning said shank between said two parallel plates and securing a pin through said first holes of said parallel plates and a hole of said shank.

3. A method as described in claim 2 wherein said parallel plates each comprise a second hole aligned with each other and operable to be aligned with an edge of said shank and wherein further said securing further comprises securing a pin through said second holes.

4. A method as described in claim 1 wherein said securing comprises positioning said shank within said rotating installer at a position along said shank closer to a top of said shank.

* * * * *